US006418191B1

(12) United States Patent
Fehre et al.

(10) Patent No.: US 6,418,191 B1
(45) Date of Patent: Jul. 9, 2002

(54) X-RAY APPARATUS AND LINE CONNECTION THEREFOR

(75) Inventors: Jens Fehre, Hausen; Werner Kuehnel, Uttenreuth, both of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/501,676

(22) Filed: Feb. 10, 2000

(30) Foreign Application Priority Data

Feb. 12, 1999 (DE) ..... 199 05 971

(51) Int. Cl.[7] ..... H05G 1/20
(52) U.S. Cl. ..... 378/105; 378/101; 363/21
(58) Field of Search ..... 378/105, 101, 378/108, 107; 362/21

(56) References Cited

U.S. PATENT DOCUMENTS 5,241,260 A * 8/1993 Beland ..... 378/117
5,250,755 A 10/1993 Dinzen et al.
5,388,139 A * 2/1995 Beland ..... 378/112
5,391,977 A * 2/1995 Beland ..... 323/268
5,966,425 A * 10/1999 Beland ..... 378/108

FOREIGN PATENT DOCUMENTS

DE 85 26 448 12/1985
DE PS 39 39 990 7/1990

OTHER PUBLICATIONS

Patent Abstracts of Japan, E–1533, Apr. 5, 1994, vol. 18, No. 106, for Japanese Application 6–5383.
"Lexikon Elektronik," Junge et al., pp. 366–374 (1994).

* cited by examiner

*Primary Examiner*—David V. Bruce
*Assistant Examiner*—Pamela R. Hobden
(74) *Attorney, Agent, or Firm*—Schiff Hardin & Waite

(57) ABSTRACT

X-ray apparatus has a d.c.-a.c. converter circuit supplied with energy that is connected via a line connection to a high-voltage transformer supplying the high-frequency operating voltage to an X-ray tube. The line connection has a first and a second conductors that are insulated from one another and are disposed close to one another for achieving a low line inductance. These conductors have ratio of radius to conductor thickness such that a low ohmic impedance is established.

22 Claims, 1 Drawing Sheet

X-RAY APPARATUS AND LINE CONNECTION THEREFOR

BACKGROUND OF THE INVENTION

1. Field of the Invention

The present invention is directed to an X-ray apparatus of the type having a d.c.-a.c. converter supplied with voltage that is connected via a line connection to a high-voltage transformer that supplies the high-frequency operating voltage to an X-ray tube.

2. Description of the Prior Art

D.c.-a.c. converter circuits with which an alternating voltage is generated are utilized in X-ray units, this alternating voltage being forwarded via a line connection to the high-voltage transformer that generates the high voltage that is required for the operation of the X-ray tube. The high voltage signal at the secondary side of this transformer is subsequently also rectified, and smoothed. The d.c.-a.c. converter is usually a series resonant circuit converter that is supplied with a d.c. voltage that is usually acquired directly from the mains voltage by rectification and filtering. It contains four semiconductor switches that are conductive in pairs in alternation on the basis of a suitable drive. The line connection is usually required in X-ray embodiments wherein the high-voltage generator, which contains the high-voltage transformer and possibly other components connected following the transformer, is provided in the immediate proximity of the X-ray tube or is contained together therewith in a single tank.

A typical resonant circuit utilized for this purpose is composed of a capacitance C and an inductance $L=L_O+L_L$, wherein $L_O$ is the stray inductance of the high-voltage transformer or transformers and $L_L$ is the line inductance of the line connection to the high-voltage generator. Particularly at high d.c.-a.c. converter power and operating frequencies of 30 kHz or higher that are currently standard, it is difficult to make the resonant circuit inductance as small as is necessary. The stray inductance $L_O$ of the high-voltage transformer cannot be arbitrarily reduced in size without having the high-voltage transformer become too large. The line inductance $L_L$ makes up a substantial part of the overall inductance L, particularly given single-tank generators that require a longer cable between d.c.-a.c. converter and single tank. An overall inductance which is too high, however, has a disadvantageous effect on the operation of the X-ray apparatus.

Japanese Published Application 6-53 83 discloses an X-ray apparatus of the above-described type.

German Utility Model 85 26 448 discloses a high-voltage X-ray cable with a grid control line. The center of the cable disclosed therein has a grid control line and two electric resistance wires that are stranded with one another. A conductive band that surrounds this configuration is in turn surrounded with the actual high-voltage conductor, which in turn carries an inner conductive layer that is surrounded by an insulation. An outer conductive layer, a shielding as well as an outside insulation are also provided. Either a single high-voltage line, or two high-voltage lines as well as two electrical resistance wires that are stranded with one another are utilized in the inside of the line in the X-ray line disclosed in German Utility Model G 91 07 953. A conductive sheath is provided around the exterior, followed by a high-voltage insulation as well as another outer conductive sheath on which a shielding is disposed that in turn carries an outside cladding. German Patent 39 29 990 discloses a low-impedance, coaxial line that has a number of coaxial cables connected in parallel.

SUMMARY OF THE INVENTION

An object of the present invention is to provide an X-ray means that can also be operated at high operating frequencies and high power.

The above object is achieved in accordance with the principles of the present invention in an X-ray apparatus having a d.c.-a.c. converter circuit supplied with energy that is connected via a line connection to a high-voltage transformer which supplies high-frequency operating voltage to an x-ray tube, wherein the line connection is composed of four concentrically arranged conductors, with a first and second of these conductors carrying the operating voltage and being insulated from each other and being disposed close to each other for achieving a low line inductance, and having a ratio of conductor radius to conductor thickness to produce a low ohmic impedance. A third of these conductors serves for shielding and is insulated from the second conductor for eliminating capacitive shift currents and is connected to a point of constant potential in the d.c.-a.c. converter. A fourth of these conductors serves for shielding and is insulated from the third conductor, and is connected to the housing of the d.c.-a.c. converter circuit, as well as to the housing of the high-voltage transformer or a device component contained within the high-voltage transformer.

In the inventive X-ray apparatus, the line connection has a low line inductance, which is inventively realized by arranging the two conductors that proceed concentrically relative to one another extremely close to one another. Inventively, the line inductance can be $\leqq 0.25\ \mu H/m$, particularly $\leqq 0.15\ \mu H/m$; the spacing between the first and the second conductor should be $\leqq 2$ mm, particularly $\leqq 1.5$ mm. Even given a long length, which usually amount to approximately 12 m or more, these low inductances contribute only slightly to the overall inductance, so that this is in an acceptable range overall. Moreover, the two current-carrying conductors of the inventive line connection have a low ohmic impedance, which can be achieved by corresponding dimensioning of the conductors as to conductor radius and conductor thickness. i.e., the line connection is also optimized with respect thereto. The ohmic impedance at high frequencies is dependent on the conductor radius and on the effective conductor layer (penetration depth). As is known, the penetration depth is dependent on the conductor material and the operating frequency. The conductor thickness should not be significantly greater than the penetration depth, thereby allowing conductor material to be saved. Given copper and a frequency of 30 kHz, for example, the penetration depth amounts to barely 0.4 mm. It is therefore inventively provided that the thickness of the conductors is $\leqq 1$ mm, particularly $\leqq 0.5$ mm. The ohmic impedance should be $\leqq 20\ m\Omega/m$, particularly $\leqq 15\ m\Omega/m$ in accordance with the invention. The low ohmic impedance leads to low losses.

Since, due to the skin effect, current conduction occurs only in the outer layer of conductors, the first, most interiorly disposed conductor in the invention can be a waveguide, which is advantageous in view of the lower use of material as a result thereof as well as in view of the flexibility and pliability of the line connection.

As described, a concentrically arranged, third conductor serving as shielding and insulated from the second conductor is inventively provided for carrying away capacitive shift currents. Such shift currents, otherwise would flow (drain) via the capacitance between the second conductor and the grounded metal parts located in the proximity without employing this shielding conductor, and would cause significant disturbances in the system as stray currents. These shift currents, are eliminated via this third conductor, which preferably at constant potential in the d.c.-a.c. converter for this purpose, i.e. the capacitive shift currents are returned into the d.c.-a.c. converter in this case and do not flow via the housing of the d.c.-a.c. converter or some other metallic article.

A concentrically arranged fourth conductor serving for shielding and insulated from the third conductor, is provided, with which the—albeit slight—magnetic field generated by the current through the third conductor is shielded, so that no shift currents having a disadvantageous influence are generated in this case, either. Inventively, the fourth conductor is connected to the housing of the d.c.-a.c. converter circuit and to the housing of the high-voltage transformer, or the housing of the system component in which the high-voltage transformer is arranged, and serves as a protective conductor, i.e. the fourth conductor performs a double function. It is especially advantageous that a separate protective conductor need not be provided. Inventively, the high-voltage transformer itself can be arranged in a common housing together with the X-ray tube; of course, it is also possible to arranged the high-voltage transformer and any following components, such as a high-voltage rectifier and high-voltage smoothing capacitors, away from the X-ray tube in a separate housing.

It has proven expedient when the first and second conductor, and potentially the third and/or fourth conductor as well, are inventively fashioned as stranded conductors whose individual wires are coated with a layer of silver or a silver alloy. This coating of the stranded conductors is advantageous, because a further reduction of the lead resistance (skin effect) is thereby achieved plus it affords a better gliding of the individual wires relative to one another, and a better conductor mobility. This is particularly advantageous in the embodiment wherein all four conductors of the cable, which can be referred to as "quadraxial cable", are provided.

In addition to the X-ray apparatus itself, the invention is also directed to a line connection, particularly for an X-ray tube of the type described above. This line connection has four conductors insulated from one another and arranged concentrically relative to one another, with the innermost first and the second conductors serving for current conduction, the third conductor serving for shielding the inner conductor pair and the fourth conductor serves for shielding the third conductor, and the first and the second conductor are arranged so close to one another that the line inductance amounts to $\leqq 0.25$ $\mu$H/m, particularly $\leqq 0.15$ $\mu$H/m, and the ratio of the conductor radius to the conductor thickness in the first and second conductor is selected such that the ohmic impedance amounts to $\leqq 20$ m$\Omega$m, particularly $\leqq 15$ m$\Omega$m.

DESCRIPTION OF THE PREFERRED EMBODIMENTS

Figure 1:
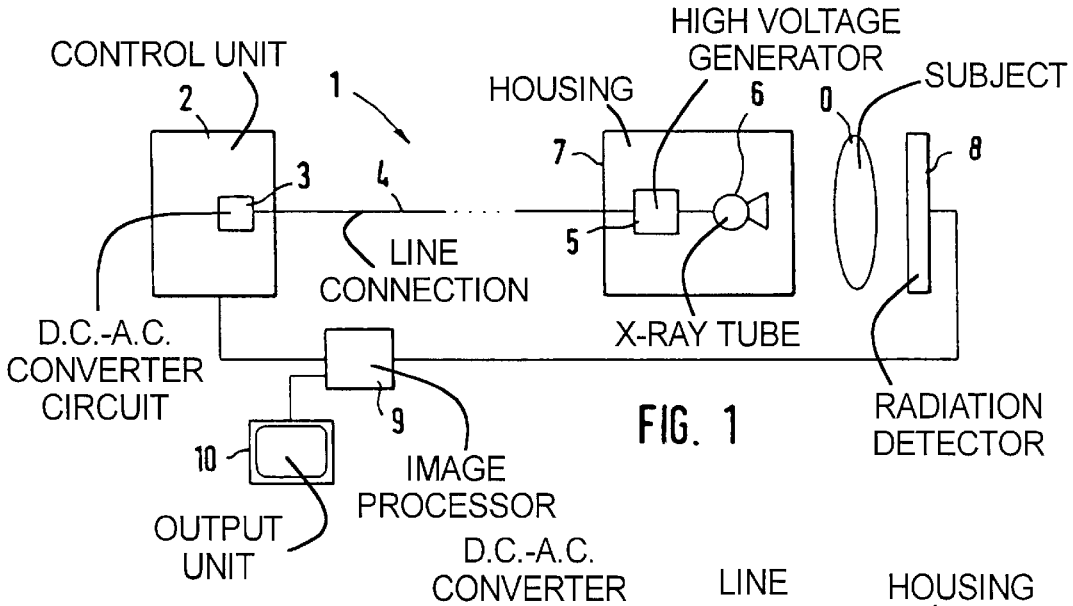
FIG. 1 is a schematic diagram of an inventive X-ray apparatus.

FIG. 1 shows an inventive X-ray apparatus 1 composed of a control unit 2 in which a d.c.-a.c. converter circuit is arranged. Via a line connection 4, this is in communication with a high-voltage generator 5 and with one or more high-voltage transformers (see FIG. 2). The high-voltage generator 5 is in turn connected to an X-ray tube 6, these two components being arranged in a common housing 7 (single-tank). The X-ray tube 6 generates X-rays that, after penetrating a subject O, are registered by a radiation detector 8 and forwarded to an image processor 9 wherein the images are processed and edited and supplied to an output unit 10, for example in the form of a monitor. FIG. 1 is only a schematic diagram that serves the purpose of indicating relevant apparatus parts.

Figure 2:
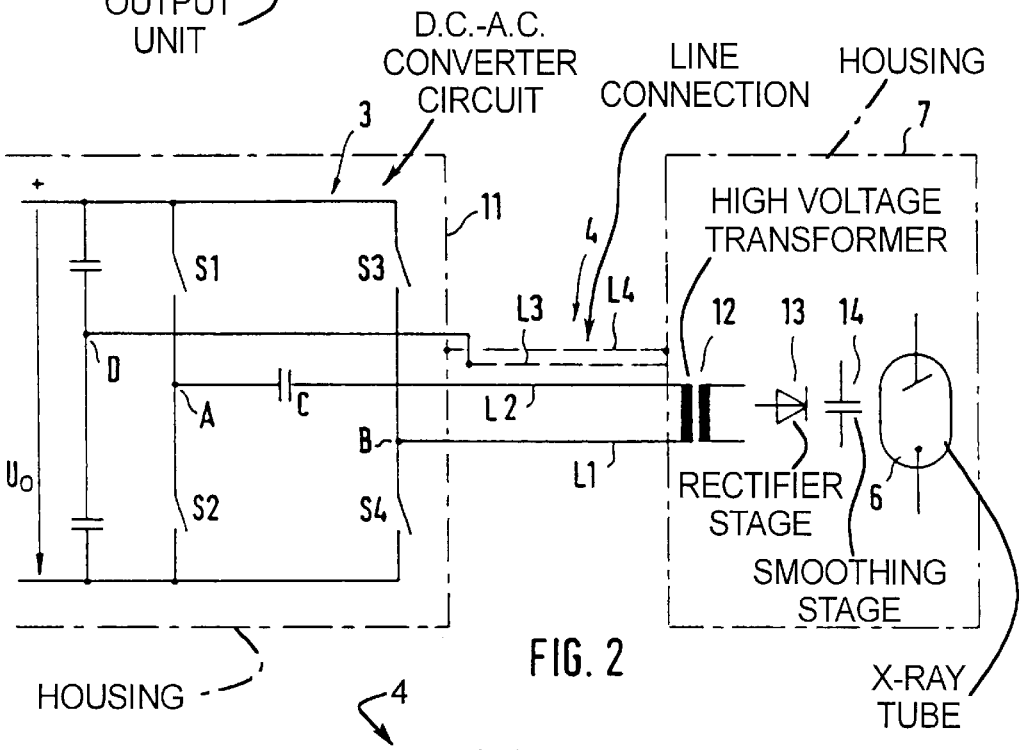
FIG. 2 is a schematic diagram of the d.c.-a.c. converter circuit, the line connection, and the high-voltage generating and X-ray unit in the inventive X-ray apparatus.
Figure 3:
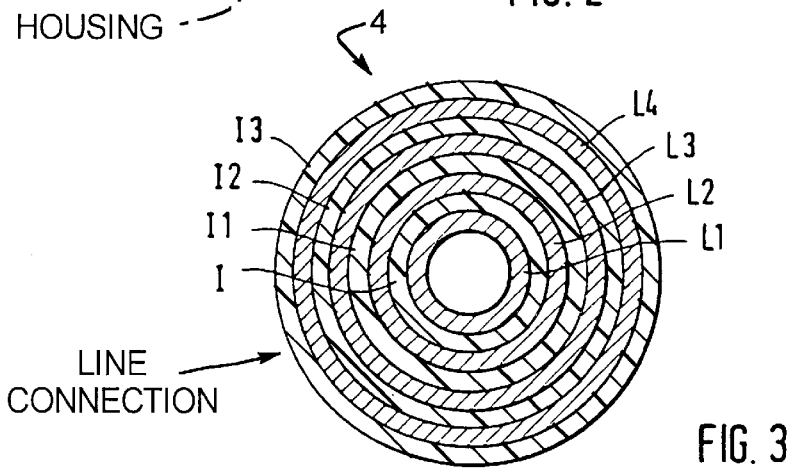
FIG. 3 is a sectional view through an inventive line connection.

In a more detailed view, FIG. 2 shows the elements for generating the high-voltage with which the X-ray tube 6 is operated. The d.c.-a.c. converter circuit 3 is shown, which is accommodated in a separate converter housing 11. The circuit has four semiconductor switches S1, S2, S3 and S4 as well as a capacitance C. The circuit 3 is supplied with a d.c. voltage $U_0$ that is usually acquired directly from the mains voltage by rectification and filtering; the elements relating thereto are not shown. The semiconductor switches S1–S4 and S2–S3 are switched so as to be conductive in pairs on the basis of a suitable drive, resulting in an alternating voltage being generated and forwarded via the line connection 4 to the high-voltage transformer 12. In the illustrated example, the high-voltage transformer is followed by a rectifier 13 as well as by a smoothing stage 14. The operating principle of the d.c.-a.c. converter circuit 3 causes a high-frequency voltage relative to ground to occur at the points A and B (the circuit usually operates with an operating frequency of 30 kHz or at higher frequencies). First and a second conductor L1 and L2 of the line connection 4 are connected to these points, these conductors being arranged concentrically relative to one another as shown in FIG. 3. The two conductors L1, L2 are arranged close to one another and are insulated from one another via an insulating layer 1. The respective opposite ends of the conductors L1 and L2 are connected to the primary winding of the high-voltage transformer 12. The two conductors L1, L2 have a low line inductance of $\leqq 0.25$ $\mu$H/m. They are dimensioned in thickness and radius as to represent a low ohmic impedance of $\leqq 0.20$m$\Omega$m.

A third conductor L3 also is provided that is likewise arranged concentrically relative to the two first conductors L1 and L2 and is insulated from the conductor L@ via an insulation layer I1. Capacitive shift currents are conducted via this third conductor L3 into the inside of the d.c.-a.c. converter 3, for which purpose the conductor L3 is connected at the point D. The point D is selected such that the voltage thereat remains essentially constant, even when the current alternates. Without this additional shielding measure, there is the risk that high capacitive shift currents would flow via the capacitance between the conductor L2 and the grounded metal parts located in the vicinity. These stray currents would lead to greater disturbances in the system and are not compatible with the EMC guidelines currently in force.

As can also be seen from FIGS. 2 and 3, a fourth conductor L4 is provided that lies at the housing 11 of the d.c.-a.c. converter circuit 3 as well as at the housing 7 of the single-tank. The albeit slight magnetic field that is generated by the currents flowing in the conductor L3 and that can in turn lead to disturbances in the sensitive electronic circuits, is shielded by this fourth shielding layer. The connection of the conductor L4 at the housing 11 as well as at the housing 7 also makes it possible to utilize this conductor L4 as a protective conductor.

FIG. 3 shows a sectional viewthrough an inventive line connection. As already set forth, it is composed of a total of four conductors L1, L2, L3, L4 that are insulated from one another and at the exterior by respectively insulation layers I1, I1, I2, I3. The conductor L1 is fashioned as waveguide since the transport of current ensues only at its surface. The spacing of the conductors L1 and L2 from one another is ≦2 mm in order to realize an optimally low line inductance. The other conductors are also similarly spaced from one another. Each conductor L1–L4 preferably is a stranded conductor composed of a number of individual copper wires that each can be coated with a layer of silver or a silver alloy. This coating is advantageous for reducing the lead resistance (skin effect) and for improving gliding of the individual wires relative to one another.

For an X-ray apparatus that is operated with a power of, for example, 30 kW and a frequency of 30 kHz, a pure series resonant circuit d.c.-a.c. converter 3 having approximately the following resonant circuit elements is required:

L=12 μH

C=0.85 μF, whereby

L=overall inductance,

C=capacitance.

The inductance is composed of the stray inductances of the high-voltage transformers and of the lead inductances. The stray inductances amount to approximately 10 μH overall, including internal wiring inductances.

Line lengths of at least 12 m are usually required for the supply of the single-tank. Given a spacing of approximately 1.55 mm between the conductors L1 and L2, an inductance of about 0.12 μH/m arises, so that a maximum line inductance of 1.44 μH is present given an assumed length of 12 m. The sum of the stray inductance and this line inductance is thus within an acceptable range. Given higher operating frequencies and/or powers, the dimensioning parameters of the line connection are correspondingly selected for achieving correspondingly required inductance and resistance values.

Although modifications and changes may be suggested by those skilled in the art, it is the intention of the inventors to embody within the patent warranted hereon all changes and modifications as reasonably and properly come within the scope of their contribution to the art.

We claim as our invention:

1. An X-ray apparatus comprising:

a d.c.-a.c. converter circuit adapted for connection to an energy source, said d.c.-a.c. converter circuit having a housing and having a circuit location therein which is at a constant potential;

an X-ray tube;

a high-voltage transformer connected to said X-ray tube for generating high-frequency operating voltage and supplying said high-frequency operating voltage to said X-ray tube, said high-voltage transformer having a housing and containing a transformer device component; and a line connection connecting said d.c.-a.c. converter circuit to said high-voltage transformer, said line connection comprising first, second, third and fourth concentrically arranged conductors, said first and second conductors being innermost conductors and carrying operating voltage and having a first insulating layer therebetween with said first and second conductors being close to each other for producing a low line inductance and each of said first and second conductors having a ratio of conductor radius to conductor thickness for producing a low ohmic impedance, a third conductor separated from said second conductor by a second insulating layer and eliminating capacitive shift currents and being connected to said location at constant potential in said d.c.-a.c. converter circuit, and a fourth conductor separated from said third conductor by a third insulation layer, said fourth conductor forming a shielding conductor and being connected to said housing of said d.c.-a.c. converter circuit and to one of said housing of said high-voltage transformer and said device component in said high-voltage transformer.

2. An X-ray apparatus as claimed in claim 1 wherein said line inductance is ≦0.25 μH/m and wherein ohmic impedance is ≦20 mΩ/m.

3. An X-ray apparatus as claimed in claim 1 wherein said line inductance is ≦0.15 μH/m and wherein ohmic impedance is ≦15 mΩ/m.

4. An X-ray apparatus as claimed in claim 1 wherein said first and second conductors are spaced from each other at a spacing which is ≦2 mm.

5. An X-ray apparatus as claimed in claim 1 wherein said first and second conductors are spaced from each other at a spacing which is ≦1.5 mm.

6. An X-ray apparatus as claimed in claim 1 wherein each of said first and second conductors has a thickness which ≦1 mm.

7. An X-ray apparatus as claimed in claim 1 wherein each of said first and second conductors has a thickness which ≦0.5 mm.

8. An X-ray apparatus as claimed in claim 1 wherein said first conductor is a waveguide.

9. An X-ray apparatus as claimed in claim 1 wherein said X-ray tube is also contained in said housing containing said high-voltage transformer.

10. An X-ray apparatus as claimed in claim 1 wherein said first and second conductors each comprise stranded conductors formed by a plurality of stranded wires, each of said wires being coated with a layer selected from the group consisting of a silver layer and a silver alloy layer.

11. An X-ray apparatus as claimed in claim 10 wherein said third conductor comprises a stranded conductor formed of a plurality of stranded wires, each of said wires being coated with a layer selected from the group consisting of a silver layer and a silver alloy layer.

12. An X-ray apparatus as claimed in claim 11 wherein said fourth conductor comprises a stranded conductor formed of a plurality of stranded wires, each of said wires being coated with a layer selected from the group consisting of a silver layer and a silver alloy layer.

13. A line connection for use in connecting a d.c.-a.c. converter circuit to a high-voltage generator in an X-ray apparatus, said line connection comprising:

first, second, third and fourth conductors which are concentrically arranged relative to each other;

said first and second conductors comprising innermost conductors and being separated from each other by a first insulation layer and serving for current conduction said first and second conductors being disposed close to each other to produce a line inductance of ≦0.25 μH/m and each having a ratio of conductor radius to conductor thickness to produce an ohmic impedance which ≦20 mΩ/m;

said third conductor being separated from said second conductor by a second insulating layer and shielding said first and second conductors; and said fourth conductor being separated from said third conductor by a third insulating layer and shielding said third conductor.

14. A line connection as claimed in claim 13 wherein said line conductance is ≦0.5 μH/m, and wherein said ohmic impedance is ≦15 mΩ/m.

15. A line connection as claimed in claim 13 wherein said first and second conductors are spaced from each other at a spacing which is ≦2 mm.

16. A line connection as claimed in claim 13 wherein said first and second conductors are spaced from each other at a spacing which is ≦1.5 mm.

17. A line connection as claimed in claim 13 wherein each of said first and second conductors has a thickness which ≦1 mm.

18. A line connection as claimed in claim 13 wherein each of said first and second conductors has a thickness which ≦0.5 mm.

19. A line connection as claimed in claim 13 wherein said first conductor is a waveguide.

20. A line connection as claimed in claim 13 wherein said first and second conductors each comprise stranded conductors formed by a plurality of stranded wires, each of said wires being coated with a layer selected from the group consisting of a silver layer and a silver alloy layer.

21. A line connection as claimed in claim 20 wherein said third conductor comprises a stranded conductor formed of a plurality of stranded wires, each of said wires being coated with a layer selected from the group consisting of a silver layer and a silver alloy layer.

22. A line connection as claimed in claim 21 wherein said fourth conductor comprises a stranded conductor formed of a plurality of stranded wires, each of said wires being coated with a layer selected from the group consisting of a silver layer and a silver alloy layer.

* * * * *